US010285509B2

(12) United States Patent
Aguillard

(10) Patent No.: US 10,285,509 B2
(45) Date of Patent: May 14, 2019

(54) INFANT ASSISTIVE DEVICE

(71) Applicant: Jennifer Lannes Aguillard, Opelousas, LA (US)

(72) Inventor: Jennifer Lannes Aguillard, Opelousas, LA (US)

( * ) Notice: Subject to any disclaimer, the term of this patent is extended or adjusted under 35 U.S.C. 154(b) by 0 days.

(21) Appl. No.: 15/726,645

(22) Filed: Oct. 6, 2017

(65) Prior Publication Data

US 2018/0098640 A1 Apr. 12, 2018

Related U.S. Application Data

(60) Provisional application No. 62/405,101, filed on Oct. 6, 2016.

(51) Int. Cl.
*A47D 1/00* (2006.01)
*A47D 15/00* (2006.01)

(52) U.S. Cl.
CPC ..... *A47D 1/006* (2013.01); *A47D 1/0081* (2017.05); *A47D 15/00* (2013.01)

(58) Field of Classification Search
CPC .... A47D 1/006; A47D 1/0081; A47D 1/0085; A47D 15/00
USPC ..... 297/170, 172, 171, 173, 174 R, 174 CS
See application file for complete search history.

(56) References Cited

U.S. PATENT DOCUMENTS 2,023,761 A * 12/1935 Drummey ..... A47B 39/02 297/172
D145,443 S * 8/1946 Harsany ..... 108/50.14
2,714,417 A * 8/1955 Golding ..... A47D 13/107 248/626
3,059,965 A * 10/1962 Fornetti ..... A47D 1/02 297/174 CS
4,075,457 A * 2/1978 Williams ..... A45D 29/22 219/218
5,149,174 A * 9/1992 Charash ..... A47C 9/005 248/125.1
5,409,296 A * 4/1995 Barile ..... A47C 9/022 248/172
5,687,433 A * 11/1997 Garner ..... A47K 3/127 297/256.15
5,728,030 A * 3/1998 Hsieh ..... A47D 13/043 472/15
6,000,750 A * 12/1999 Rossman ..... A47D 1/004 108/11
6,817,864 B1 * 11/2004 Martinez ..... A47D 1/008 434/258

(Continued)

*Primary Examiner* — Mark R Wendell
(74) *Attorney, Agent, or Firm* — Juan J. Lizarraga

(57) ABSTRACT

An assistive device for infants or toddlers unable to hold themselves up to sit against gravity with a trunk support, a trunk support base a crossbar with a vertical support tube and a vertical extension tube forward of the front end of the trunk support base, and a removable floor plate with an upper non skid surface upon which the bottom surface of the trunk support base rests to provide mechanical support and stability needed to promote independent muscle activation in an infant or toddler who cannot sit up after the age of 7 months. Additional features comprise an angled tray for added upper extremity weight bearing assistance while simultaneously viewing eye-level book/toys and grasping of a crossbar to promote sit to stand, heating and cooling gel wrap and vibration disc.

4 Claims, 6 Drawing Sheets

(56) References Cited

U.S. PATENT DOCUMENTS

| | | | | |
|---|---|---|---|---|
| 7,052,082 | B1 * | 5/2006 | Thomas | A47C 1/04 297/148 |
| 8,944,514 | B2 * | 2/2015 | Tadin | A63H 33/006 297/219.12 |
| 9,474,377 | B2 * | 10/2016 | Keen | A47C 7/506 |
| 2001/0015567 | A1 * | 8/2001 | Tholkes | A47B 9/00 297/172 |
| 2005/0229302 | A1 * | 10/2005 | Sundberg | A47K 3/034 4/572.1 |
| 2007/0182222 | A1 * | 8/2007 | Griepentrog | A47B 39/00 297/172 |
| 2009/0230738 | A1 * | 9/2009 | Le | A47C 1/11 297/217.4 |
| 2014/0008943 | A1 * | 1/2014 | Benden | A47B 39/00 297/135 |
| 2014/0203528 | A1 * | 7/2014 | Bussinger | A61G 5/10 280/33.996 |
| 2014/0252737 | A1 * | 9/2014 | Maxie | A47D 13/025 280/47.38 |

* cited by examiner

INFANT ASSISTIVE DEVICE

This application claims priority from U.S. Provisional Application No. 62/405,101 (the '101 application), filed Oct. 6, 2016. The '101 application is incorporated herein by reference.

BACKGROUND OF THE INVENTION

The present invention helps an infant or toddler who is unable to hold himself or herself up to sit and stand against gravity. When children have grown past one year old and are not only not walking, but not sitting as well, they need special assistance. Current devices don't work well because when a child needs special assistance they need more sensory input and support to activate their muscles to sit independently.

Current infant-toddler seating devices do not provide for the infant to sit with their feet flat on the floor/pelvis in neutral/femur contact on seating surface. Current infant sitting devices also do not provide vibration stimulation to the muscles. Current infant and toddler seating devices do not provide light touch trunk contact when the infant is sitting in a seated position as when they are on a stool. Current infant-toddler products also do not have the capability of adding accessory items. Babies with special needs and challenges sometimes need more alignment assistance, sensory input and contact support to their trunk. The present invention will help them to activate the muscles needed to sit independently, and progress from sitting to standing. Accessories (like vibration, a tray, and sensory footplate) and assistive devices for this age group (approximately but not limited to 7 months to 2 years old) are helpful in special needs situations and not provided as described previously above by other products. Only the present invention provides the necessary support for infant/toddlers requiring special assistance and/or with muscle diseases.

The present invention helps activate their muscles as they need to continue to develop on the normal progression of developmental motor milestones. There are no products providing this sort of stimulation to infant-toddlers while sitting upright.

SUMMARY OF THE INVENTION

The present invention helps an infant or toddler who is unable to hold himself or herself up to sit against gravity. The invention claimed here solves this problem.

With proper alignment and weight bearing of the pelvis and lower extremities, a sensory foot plate, light touch trunk contact and support, and vibration/heating/cooling stimulation; this assistive device helps activate muscles needed to sit independently in an infant or toddler experiencing challenges.

The present invention allows for sensory input through the feet and lower extremity bones by adding the component of a stable sensory footplate, on the floor, that is nonskid for added stability/anchoring of the lower body. It also accommodates for the growing size of an infant as they are not able to sit alone. It provides light support and stability needed to promote independent muscle activation in an infant or toddler who cannot sit up after the age of 7 months. It has an added component of turning vibration on or off. It also has the added component of a sensory footplate that is nonskid for added stability/anchoring of the lower body. An angled tray for further upper extremity weight bearing assist can be added to the assisted sitting device. This tray can be adjusted to the true vertical position (90 degrees from the horizontal) to act as an easel.

The present invention is an infant sitting device that has the ability to put an infant in a bench sitting posture of 90/90/90 degrees at hips, knees & ankles. It has a foam trunk support that gives support in all planes of movement, preventing the infant from falling over while learning to sit but is not designed to have total support along the back/high back support. A high back support allows the infant to relax and sit semi reclined, and not actively working on sitting up. The present invention is designed to facilitate sitting erect. The present invention is designed to help an infant with special needs (but not limited to) sit up if they are not doing so by 7 months of age all the way up to 24 months of age. The trunk foam support has sensory components of heating/cooling & vibration for both stimulation and relaxation as needed. The feet are flat on the floor unlike other infant sitting pillows and products which foster infant floor sitting with legs criss crossed or just the entire leg out flat against floor. Because the feet are flat on the floor, sensory input can be provided to soles of the feet giving weight bearing and other stimulation to the lower extremity muscles. The footplate contains different sensory textures to try with the infant. The footplate can even hold warm water to assist with relaxing spastic muscles. The tray attachment allows for upper extremity weight bearing to further stabilize a child who is having trouble sitting up. The tray can be angled to accommodate a variety of eye level tasks. This includes horizontal, watching a car roll back & forth or complete vertical to use as an easel if enough control is there. When the tray is removed there is a telescoping crossbar that the child can hold onto which allows for the beginning of sit-to-stand motion actively achieved by the infant and caregiver assisting if necessary weight bearing through his/her legs to hopefully a full stance one day.

DETAILED DESCRIPTION OF THE INVENTION

Figure 1:
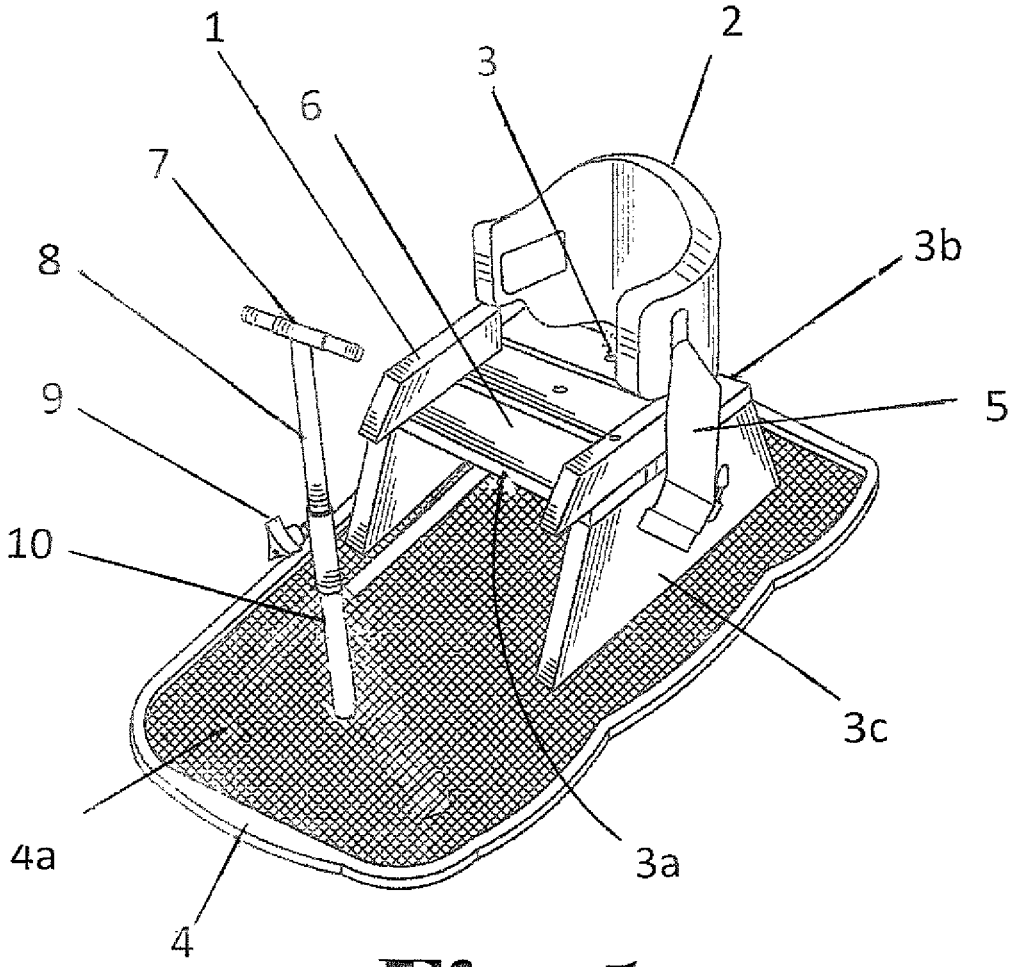
FIG. 1 is a perspective view of the inventive assistive device mounted on a removable stable sensory footplate.

In FIG. 1 the inventive assistive device 1 is shown with a trunk support 2 providing trunk support in all planes sitting on a trunk support base 3 with a front end 3*a*, a rear end 3*b* and a bottom surface 3*c* resting on the upper surface 4*a* of a removable sensory foot plate 4. It is intended that the removable foot plate 4 be stable and the upper surface 4*a* be non-skid. Also shown in FIG. 1 is the sitting surface 6 on the trunk support base 3, and a belt 5 for a sitting infant. In front of the trunk support 2 and trunk support base 3 is shown a primary crossbar 7 atop a primary crossbar extension pole 8 mounted in a primary crossbar vertical support tube 10 with an extension pole lock 9 to lock the primary crossbar in a desired vertical position. It is further understood that the trunk support 2 and the removable sensory foot plate 4 can contain a variety of interchangeable sensory input devices and materials. The crossbar 7 can be used as a handle for the infant/toddler to grab hold of to stand.

Figure 2:
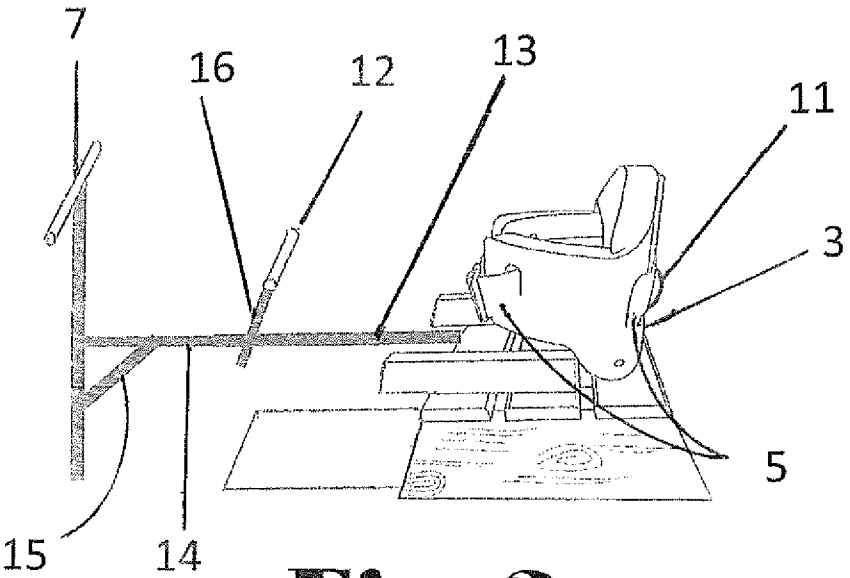
FIG. 2 is a side view of the inventive assistive device showing a trunk support on a trunk support base with a primary crossbar and an intermediate crossbar extending from the trunk support base.

In the side view of the inventive assistive device 1 shown in FIG. 2 is shown an intermediate crossbar 12 atop and perpendicular to an intermediate crossbar support pole 16 pivotally mounted to a horizontal crossbar support 13 extending from the trunk support base 3. Also shown is a horizontal crossbar extension 14 and a primary crossbar support strut 15. Also shown is an optional vibration disc 11 mounted in the trunk belt 5. The vibration disc 11 can be battery powered with an on/off switch.

Figure 3:
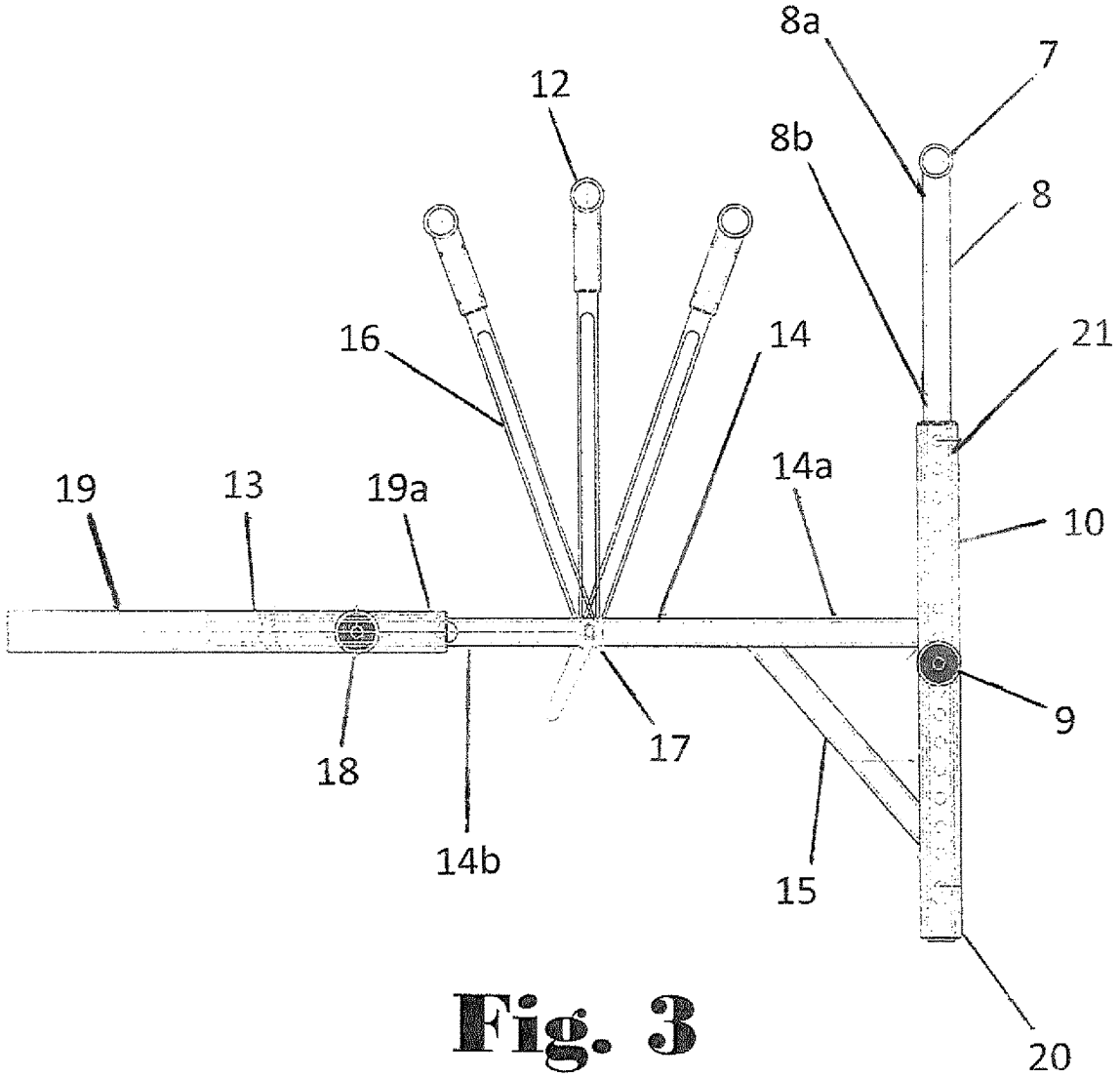
FIG. 3 is a side view of the primary crossbar and an intermediate crossbar and support structure extending from the front of the trunk support base and meant to be between the legs of the infant sitting in the inventive assistive device.

FIG. 3 is a side view of the primary crossbar 7 and intermediate crossbar 12 and support structure comprising a horizontal cross bar support 13 having a rear end 19 and a front end 19*a* with a horizontal crossbar extension 14 having a rear end 14*b* and a front end 14*a*. As shown the rear end 14*b* of the horizontal crossbar extension 14 slides into the front end 19*a* of the horizontal crossbar support 13 where the rear end 14*b* can be locked in a multiplicity of positions with a horizontal crossbar extension lock 18 to accommodate different sizes of infants. The rear end 19 of the horizontal crossbar support 13 is supported at the front of the trunk support base 3. The horizontal crossbar support 13 is meant to be between the legs of the infant sitting in the inventive assistive device 1.

Also shown in FIG. 3, the intermediate crossbar support pole 16 fixed at a right angle to the intermediate crossbar 12 is mounted to the horizontal crossbar extension 14 at pivot point 17. As shown the support pole 16 can be locked at various vertical angles in relation to the horizontal crossbar extension 14, or can be removed altogether. At the front end 14*a* of the horizontal crossbar extension 14, a primary crossbar support tube 10 with a bottom end 20 and a top end 21 is fixed in a vertical position, with an optional support strut 15. While not shown, additional support struts may be used to provide transverse support to the support tube 10. It is intended that the bottom end 20 rests on the floor or the upper surface 4*a* of the removable foot plate 4. In addition there is a primary crossbar extension pole 8 with a top end 8*a* fixed at a right angle to the primary crossbar 7, and a bottom end 8*b* inserted into the top end 21 of the primary crossbar support tube 10 where the primary crossbar extension pole 8 can be locked in a multiplicity of vertical positions with an extension pole lock 9 to accommodate different sizes of infants or accommodate attachments.

Figure 4:
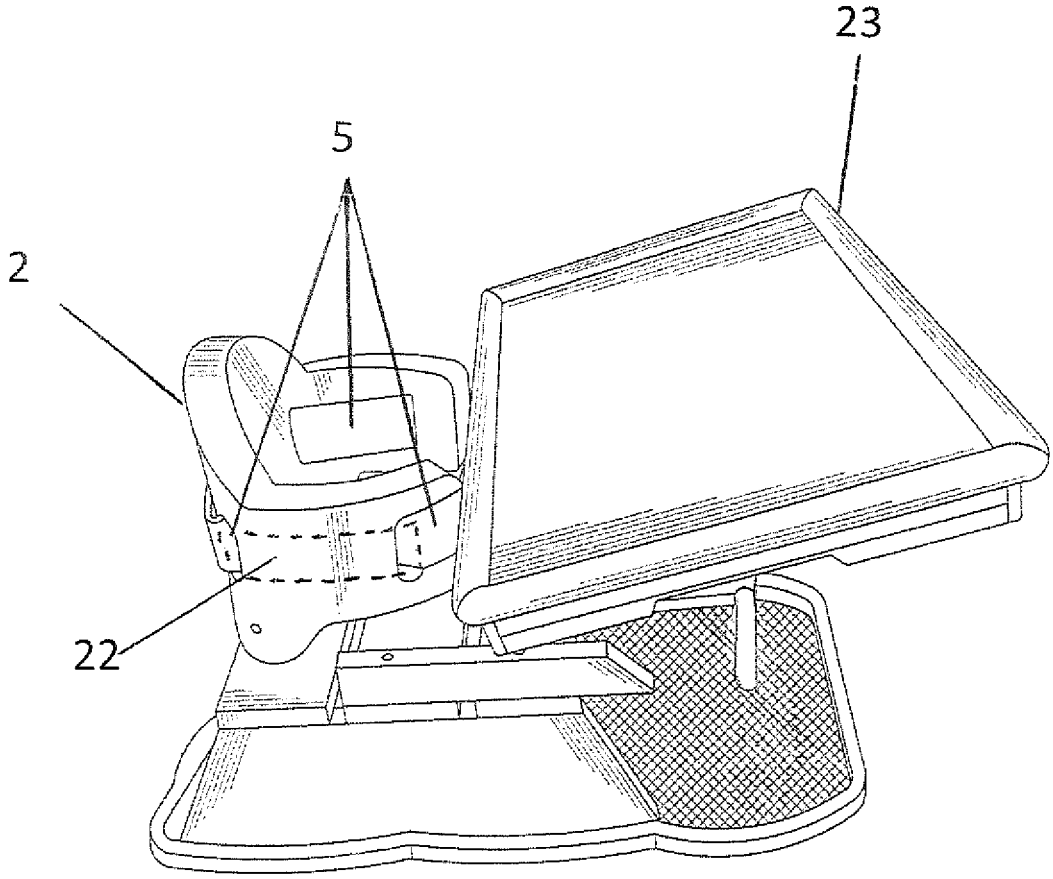
FIG. 4 is another side view of the inventive assistive device showing a tray that can be mounted on one of the cross bars.

The side view of the inventive assistive device depicted in FIG. 4 shows a tray 23 that can be mounted on one or both of the cross bars 12 and 7. As noted above the primary crossbar 7 can be adjusted vertically to accommodate the tray 23, and the intermediate crossbar 12 can be adjusted to accommodate a desired angle for the tray 23 or removed altogether to allow adjustment of a tray 23 to the true vertical position (90 degrees from the horizontal) such that the tray 23 can act as an easel as well. Also shown is a heating and cooling gel wrap 22 installed in the trunk support 2 or alternatively in the trunk support belt 5.

The trunk support 2 can be removed or loosened as the child begins to activate his/her own muscle and develops the ability to sit alone and stabilize himself/herself. The removable foot plate 4 with non-skid upper surface 4*a* insures that the child will be anchored and learn to stabilize himself/herself when sitting by maintaining their feet on the floor. The trunk support 2 can also be removed so that the child can become closer and closer to independent sitting on a stool, bench surface, or floor like typical babies learn to do. Both the trunk support 2 and the removable foot plate 4 can have a stimulation component added to them that can be utilized to further activate a baby to use their muscles that they are having trouble activating.

Figure 5A:
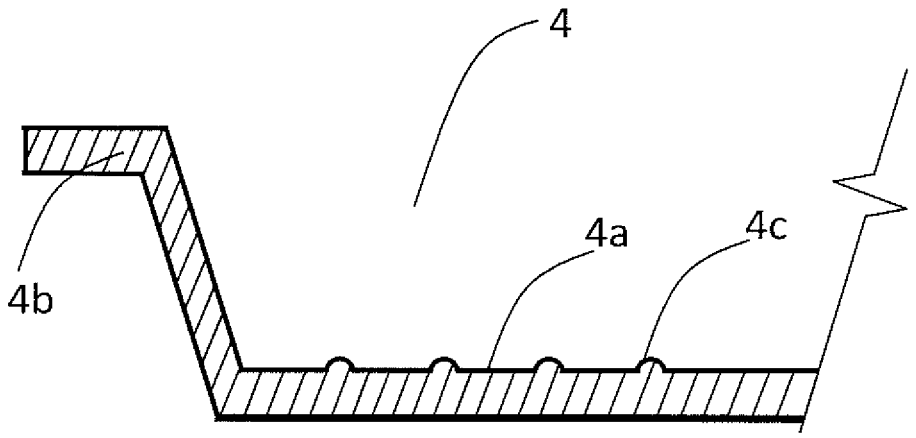
FIGS. 5A through 5D are partial cross sections of the removable stable sensory foot plate showing interchangeable sensory input devices with different textures and materials.
Figure 5B:
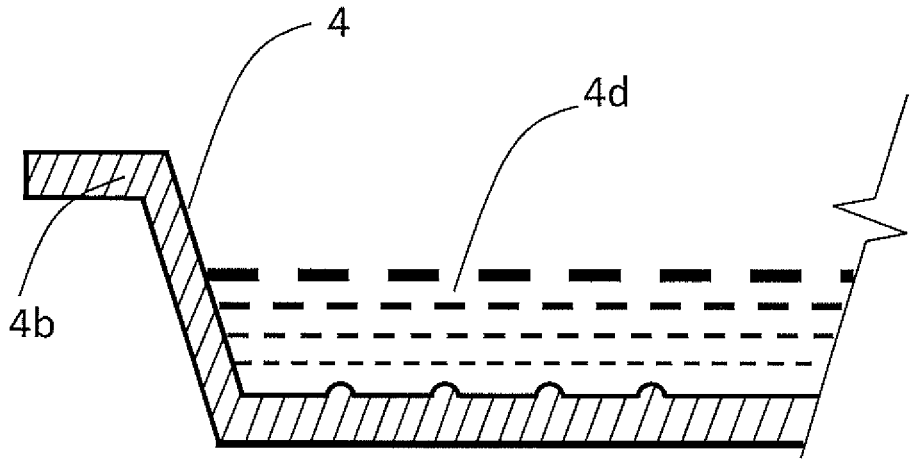
Figure 5C:
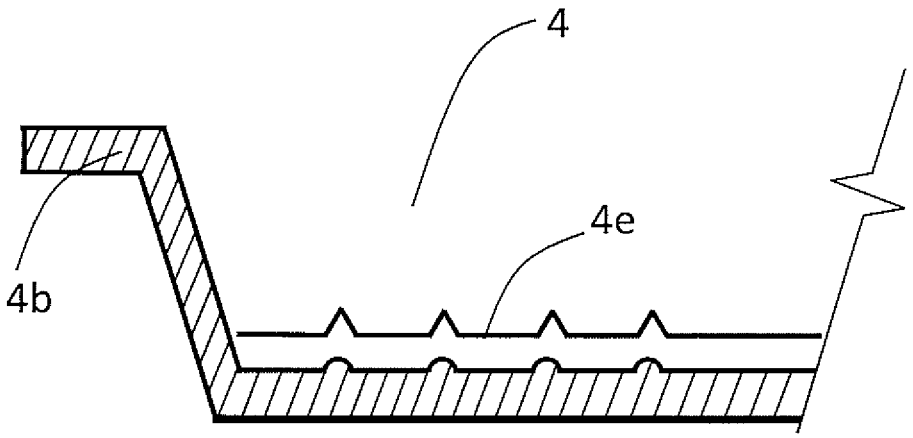
Figure 5D:
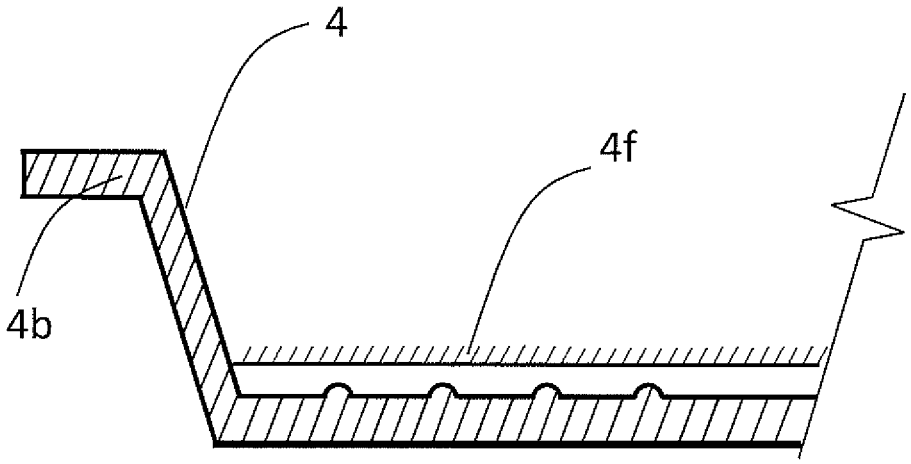

FIG. 5A shows a partial cross section of the removable stable sensory foot plate 4 with a rim 4*b* and the non-skid features 4*c* on the upper surface 4*a*. In FIG. 5B the removable stable sensory foot plate 4 is shown partially filled with warm water 4*d* for sensory input. In FIG. 5C the removable stable sensory foot plate 4 is shown lined with a sensory input layer 4*e* over the non-skid features 4*c* on the upper surface 4*a*. Likewise, in FIG. 5D a sensory input layer 4*f* with a different sensory texture than layer 4*e* is placed over the non-skid features 4*c* on the upper surface 4*a*.

As everyone knows no two people are made alike. Although the size of the present invention fits most children in the 7 month to 2 year old range it needs to be tested for fit by the user/parent. Supervision while using the device is also needed to monitor the infant's tolerance to sitting upright. As the child grows the crossbar 7 can be adjusted and likewise the trunk support base 3 can be raised. For example, the vertical distance between the floor or the non-skid upper surface 4*a* and the sitting surface 6 would be 5 inches for small sizes but 7 inches for medium sizes to accommodate an increase in tibia length or foot to knee measurement.

A person using the present invention would be a therapist, teacher, or a parent/sitter. This person would properly place the child into the device and stimulate the child to hold their head and trunk up to look at visual tasks/toys at eye level while interacting with the crossbar 7 or tray 23. The child in the device 1 would be monitored for tolerance and endurance to sitting. The device is designed to be used at intervals of 5 to 30 minutes at a time with supervision by an adult to increase the ability of a baby with special needs to sit alone.

I claim:

1. An assistive device for infants or toddlers unable to hold themselves up to sit against gravity comprising; a removable trunk support configured to facilitate sitting erect and give support in all planes of movement and further comprises a trunk support belt and where the trunk support further comprises vibration discs, and heating and cooling wrap for sensory input to an infant, a trunk support base having a front end and a rear end and a sitting surface and a bottom surface, a removable sensory foot plate capable of holding water with an upper non skid surface upon which the bottom surface of the trunk support base rests, at least one vertically adjustable crossbar with a vertical support tube and a vertical extension tube forward of the front end of the trunk support base.

2. The assistive device of claim 1 further comprising an adjustable tray supported by the at least one vertically adjustable crossbar.

3. The assistive device of claim 1 where the removable sensory foot plate further comprises sensory input devices.

4. The assistive device of claim 2 where the removable sensory foot plate further comprises sensory input devices.

* * * * *